US005616109A

United States Patent [19]

Szu-Ming

[11] Patent Number: 5,616,109

[45] Date of Patent: Apr. 1, 1997

[54] RESILIENT ABDOMINAL-ARM EXERCISE APPARATUS

[76] Inventor: Huang Szu-Ming, No. 18, Lane 164, Hsin I Road, Tou Fen Chang, Miao Li Shien, Taiwan

[21] Appl. No.: 614,237

[22] Filed: Mar. 12, 1996

[51] Int. Cl.[6] ..... A63B 21/04; A63B 21/02

[52] U.S. Cl. ..... 482/123; 482/130; 482/129

[58] Field of Search ..... 601/41; 482/121–134, 482/142

[56] References Cited

U.S. PATENT DOCUMENTS

| | | | |
|---|---|---|---|
| 4,775,148 | 10/1988 | McLanghlin | 482/121 |
| 4,915,379 | 4/1990 | Sapp | 482/130 |
| 5,085,429 | 2/1992 | Van Der Hoeven | 482/130 |
| 5,184,606 | 2/1993 | Csorba | 601/41 |

*Primary Examiner*—Richard J. Apley
*Assistant Examiner*—William LaMarca
*Attorney, Agent, or Firm*—Morton J. Rosenberg; David I. Klein

[57] ABSTRACT

The invention relates to a body-building apparatus that primarily comprises a board with a fulcrum bar attached to one end thereof. The fulcrum bar is provided at its top end with a lever arm to which springs are connected. An abdominal press is affixed to the lever arm. With this apparatus, users can exercise their arm strength and reduce fat in their abdomen at the same time.

1 Claim, 6 Drawing Sheets

RESILIENT ABDOMINAL-ARM EXERCISE APPARATUS

BACKGROUND OF THE INVENTION

There are several kinds of body-building apparatuses in the market. However, no matter how many features a multipurpose body-building apparatus would have, it can only be used for one kind of exercises each time, such as running, sit-up, and so on. A user who wants to practice two or more kinds of exercises has to do them individually.

The primary object of the invention is to provide a body-building apparatus that is easy to operate and that can perform two exercise items at the same time.

BRIEF DESCRIPTION OF THE ACCOMPANYING DRAWINGS

The structure and features of the present invention will be now described in detail with reference to the accompanying drawings, wherein:

FIG. 1 perspectively shows the outer appearance of the body-building apparatus according to the invention, FIG. 2 is an exploded view showing some parts of the body-building apparatus of FIG. 1, FIG. 3 is a cross sectional view showing some parts of the apparatus in an assembled state, and FIGS. 4 through 6 show the use of the apparatus.

DETAILED DESCRIPTION OF PREFERRED EMBODIMENTS

Figure 1:
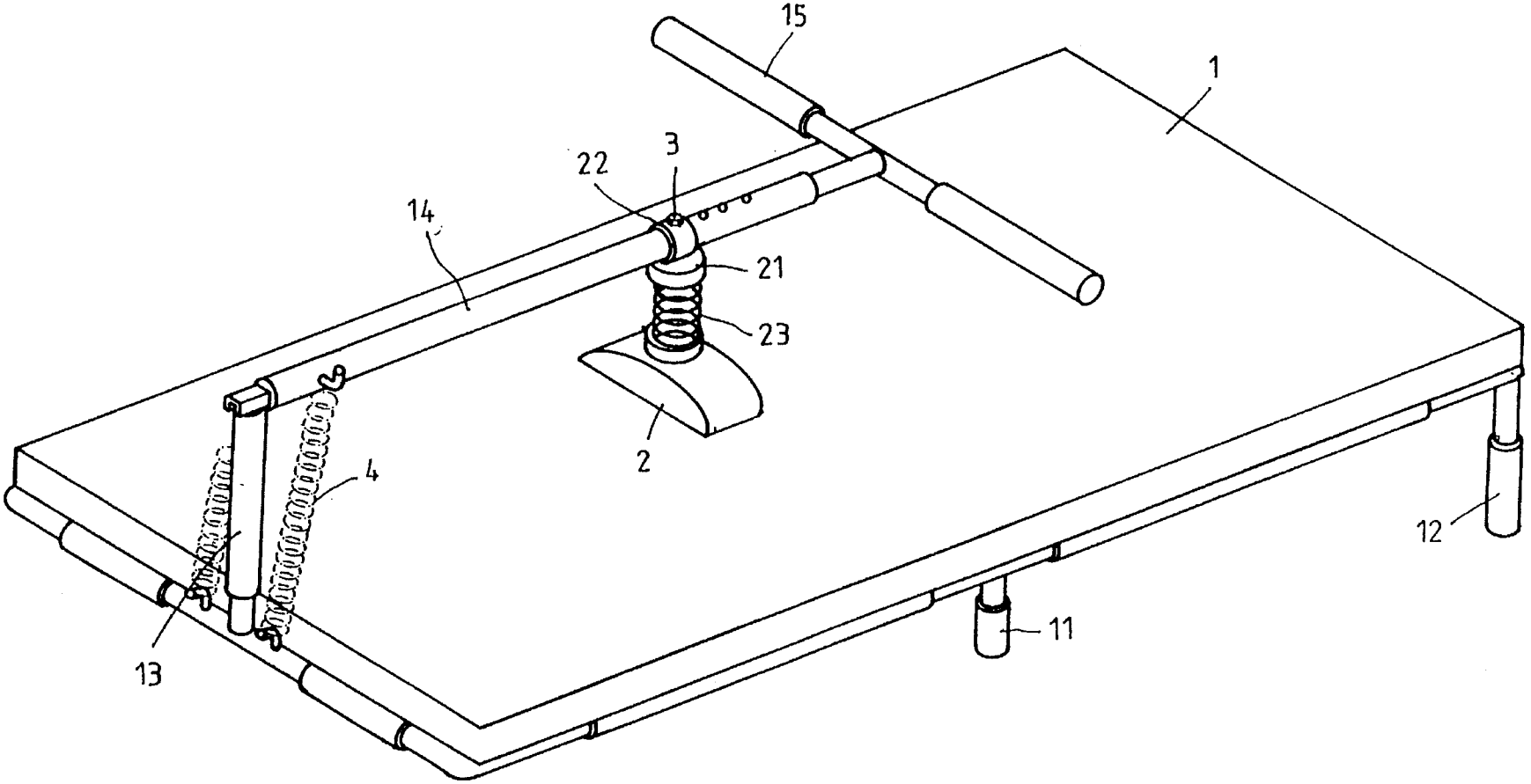
Figure 2:
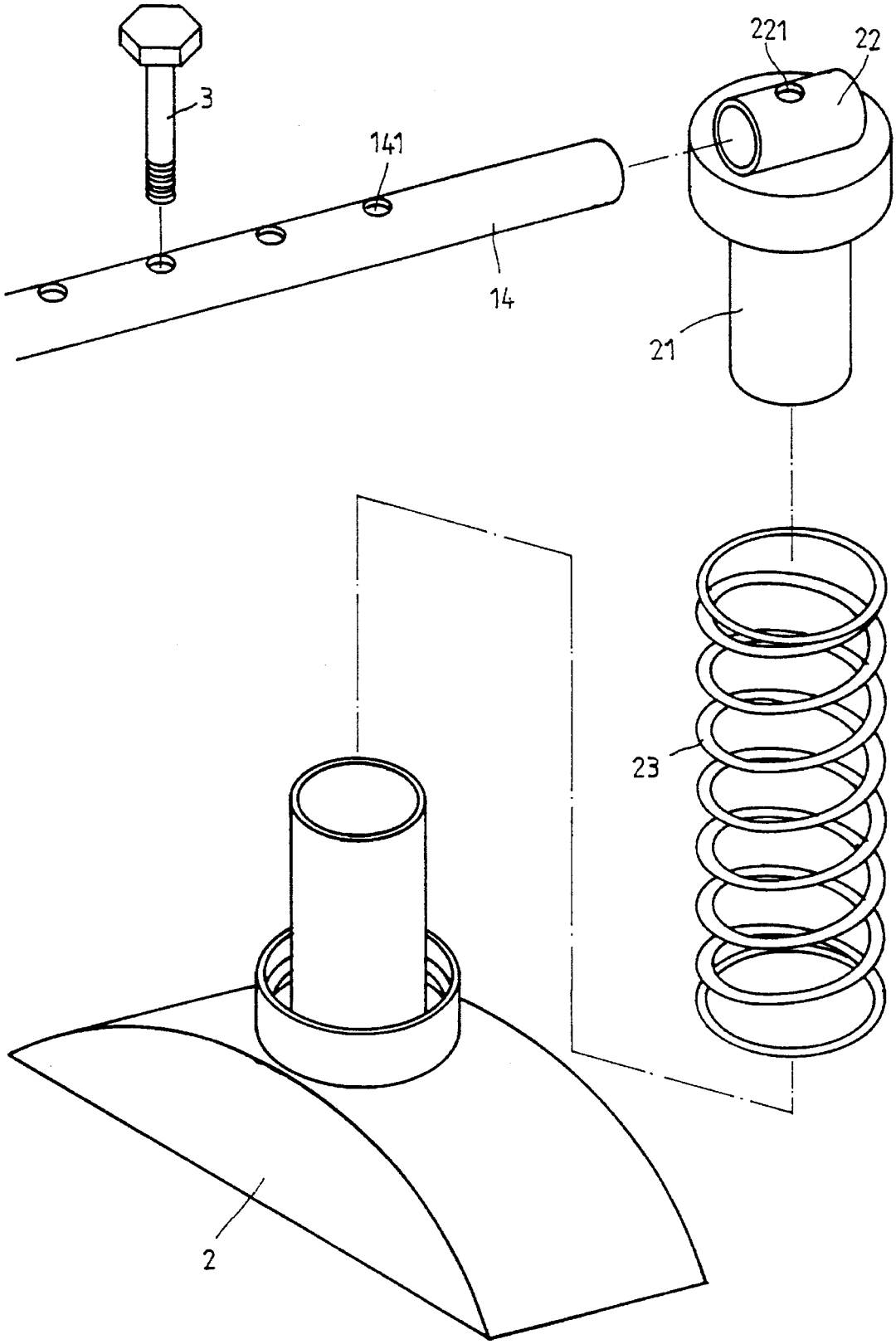
Figure 3:
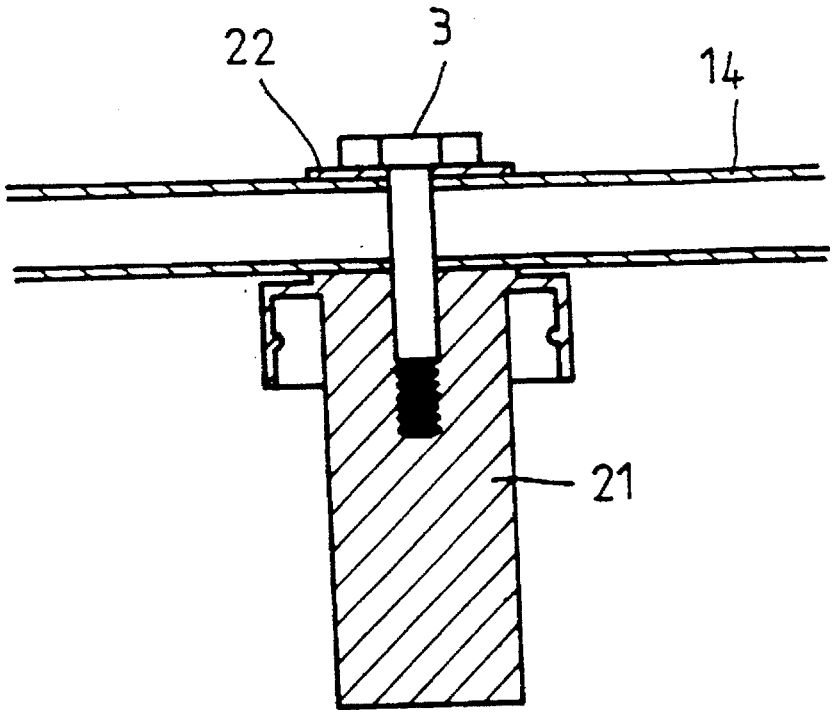

Referring to FIGS. 1 through 3, there is shown a body-building apparatus of the invention. As can be seen from the drawings, the apparatus comprises a board (1) having opposing first and second ends with supports (12) disposed at the first end and supports (11) disposed at two sides of the middle section thereof in such a way that the board is inclined as it stands on the supports. The second end of the board (1) is provided with an upwardly extending fulcrum bar (13) at the top end of which a lever arm (14) is pivotally attached. The lever arm (14) has a plurality of positioning holes (141) formed on it and extends longitudinally over the board, ending with a transversely extending handle (15).

An abdominal press (2) includes the connecting means (21) with a tubular portion (22) formed on its top. The tubular portion (22) has a hole (221) formed on the tubular wall and is sized to receive the lever arm (14), with a bolt (3) extending through the hole (221) and one of the positioning holes (141) to combine the connecting means (21) with the lever arm (14). The positioning hole may be so selected as to make the position of the abdominal press (2) suitable for a user's body size. The lower end of the connecting means (21) extends into a spring (23) and is attached to the base of the abdominal press (2). The bottom face of the base is flat. Furthermore, two additional springs (4) may be added to the lever arm (14) in the section near the pivoted end.

Figure 4:
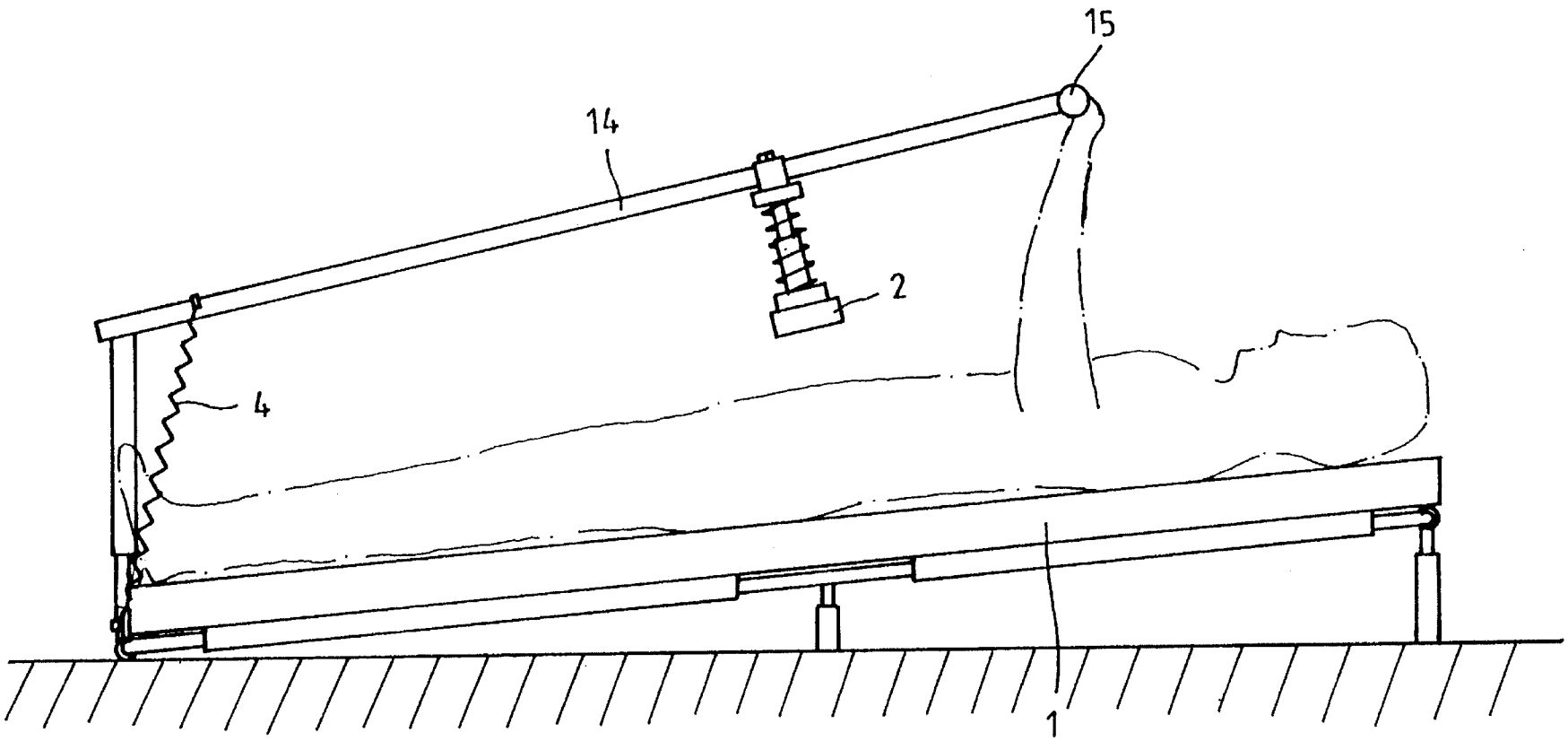
Figure 5:
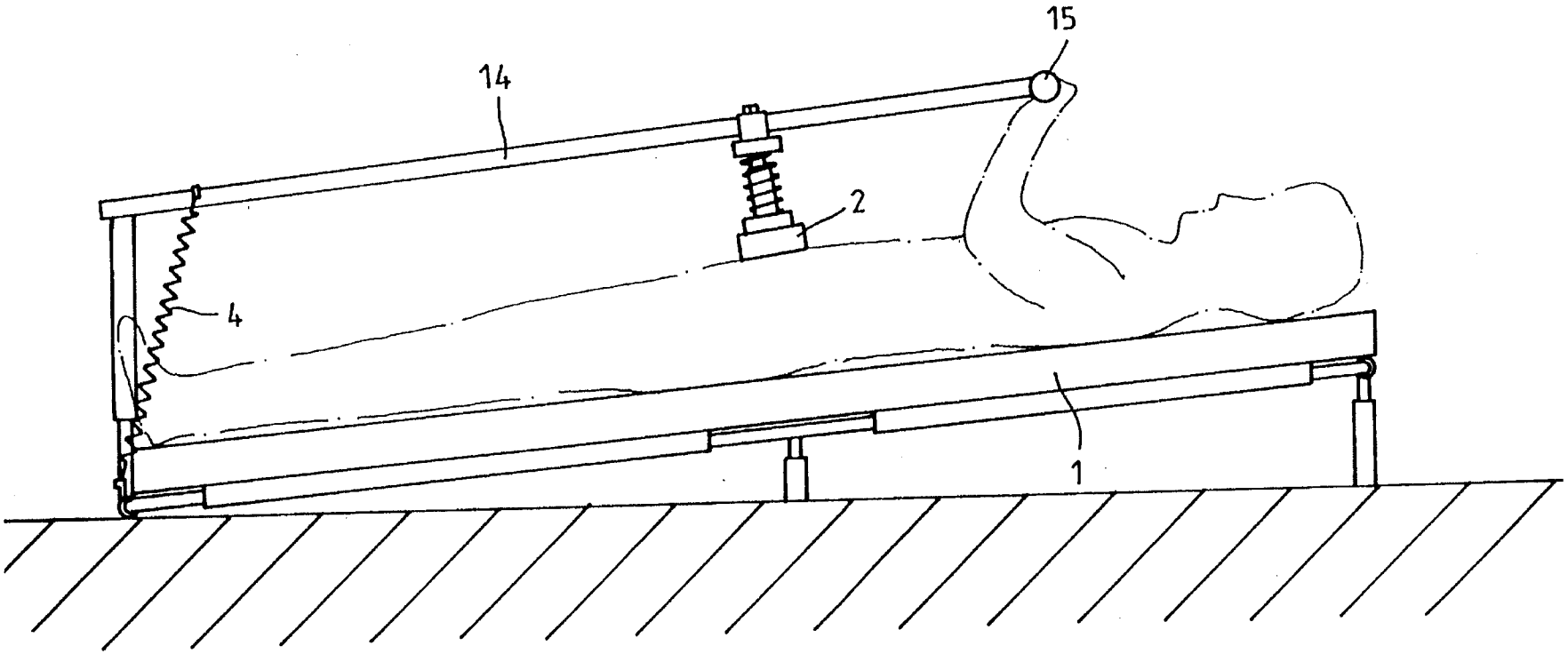
Figure 6:
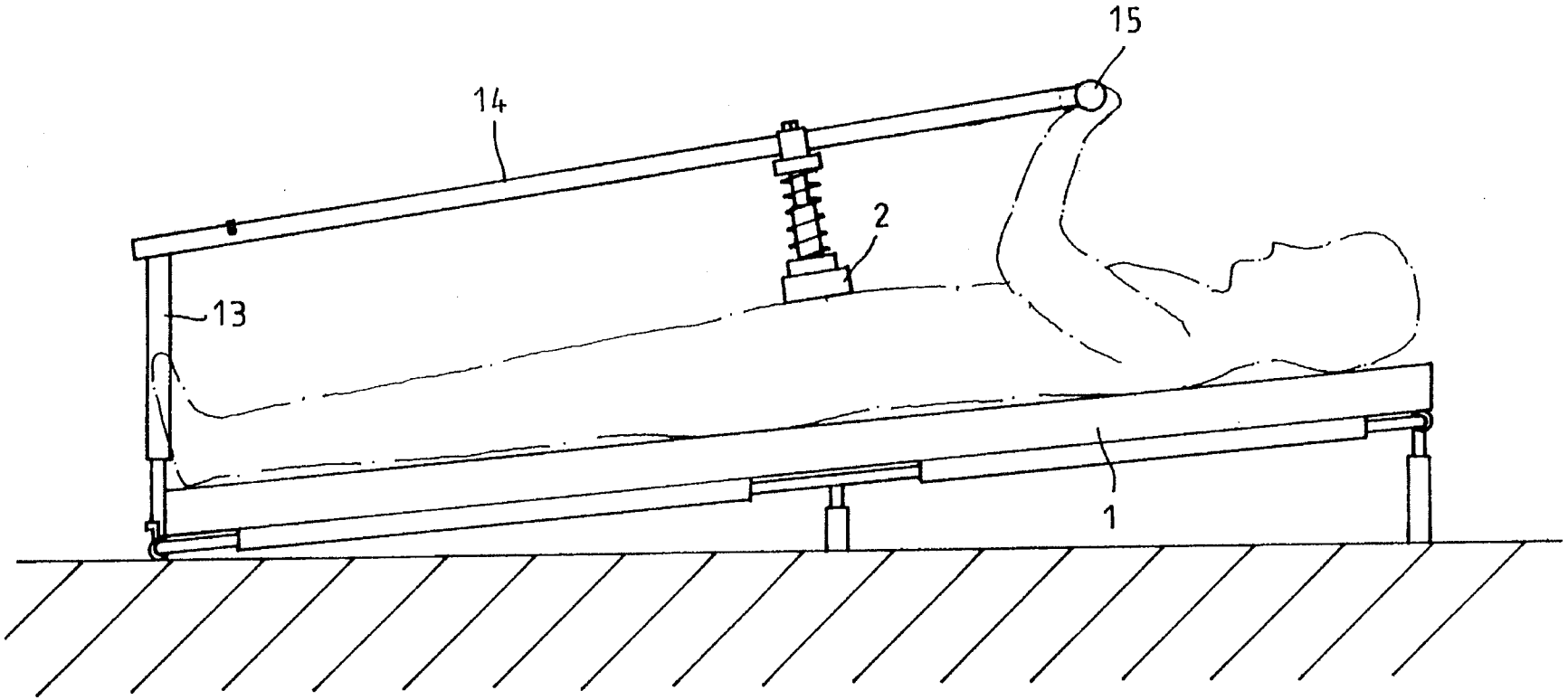

The body-building apparatus of the invention is operated as follows. Referring to FIGS. 4 and 5, a user lies on the board (1) and adjusts the abdominal press (2) to a position corresponding to his belly and then grasps the handle (15) by hands. When the user raises hands repeatedly, his arms move up and down, which can exercise his arms while squeezing the abdomen by the press to reduce excessive fat. When only the action of squeezing the belly is desired, a user can detach two springs (4) and then use the apparatus.

As described above, the body-building apparatus according to the invention provides two kinds of physical exercises, which can be conducted either simultaneously or individually. Evidently it can enhance the value of a body-building apparatus. Hence, we hereby file a patent application.

What is claimed is:

1. A body-building apparatus, comprising:

a board having an upwardly extending fulcrum bar disposed on one end thereof;

a longitudinally extended lever arm having a first end pivotally connected to an upper end of said fulcrum bar and a second end disposed over said board, said second end of said lever arm having a transversely extending handle, said lever arm having a plurality of longitudinally spaced positioning holes formed therethrough;

a plurality of first springs coupled between said board and said lever arm, said plurality of first springs being coupled to said lever arm at a position located adjacent said first end thereof; and, an abdominal press coupled to said lever arm by a bolt, said abdominal press including a press member, connecting means disposed above said press member and a second spring disposed intermediate said press member and said connecting means, said connecting means having a tubular portion formed on an upper end thereof, said tubular portion being adapted to receive said lever arm longitudinally therethrough, said tubular portion having an opening formed transverse said longitudinal direction adapted to receive said bolt therein, said opening being alignable with a selected one of said positioning holes for passage of said bolt through both said opening and said selected positioning hole to couple said abdominal press to said lever arm.

* * * * *